United States Patent [19]

Held et al.

[11] Patent Number: 4,903,382

[45] Date of Patent: Feb. 27, 1990

[54] PRESSURE ARMED RELEASE DEVICE

[75] Inventors: Jimmy L. Held; Charles E. Tallerino, both of San Diego, Calif.

[73] Assignee: The United States of America as represented by the Secretary of the Navy, Washington, D.C.

[21] Appl. No.: 400,849

[22] Filed: Aug. 30, 1989

[51] Int. Cl.[4] ..... A44B 11/25

[52] U.S. Cl. ..... 24/602; 24/603

[58] Field of Search ..... 24/602, 603, 651, 652

[56] References Cited

U.S. PATENT DOCUMENTS

| | | | |
|---|---|---|---|
| 2,824,315 | 2/1958 | McKenny | 24/602 |
| 3,262,173 | 7/1966 | Pickens | 24/603 |
| 3,337,255 | 8/1967 | Nicoloff | 24/603 |
| 3,581,352 | 6/1971 | Lavin | 24/602 |
| 4,571,788 | 2/1986 | Bruengger | 24/602 |

*Primary Examiner*—Victor N. Sakran

*Attorney, Agent, or Firm*—Harvey Fendelman; Thomas Glenn Keough

[57] ABSTRACT

A mechanical release of an object occurs after a release device is subjected to a first pressure and then is brought to a second pressure which is less than the first. The first pressure enables or arms the device so that its actuation or release takes place when the second, specific release pressure is reached. The setting and releasing pressures are substantially less than extremely high pressures which the device is capable of withstanding. A pair of opposed biasing springs and a diaphragm with a specifically contoured solid stop prevent deformation and any sliding of sealing surfaces to avoid failure.

11 Claims, 5 Drawing Sheets

PRESSURE ARMED RELEASE DEVICE

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

Mechanical release devices that are actuated when a predetermined pressure is released are many and varied in design. The releases generally are used to separate from a ballast or a float so that a package of interest can be recovered or otherwise deployed. Piston-type release devices using shear pins that are responsive to specific pressures have relied upon springs and the like to perform the separation function once a predetermined pressure is reached. A more sophisticated, double action pressure release device of U.S. Pat. No. 4,571,788 is activated at a deeper depth and comes apart at a lesser depth. The pressure release appears to be relatively uncomplicated and has a piston provided with a sliding seal that moves along a relatively long bore within a housing to effect the flooding of the housing after a predetermined lesser depth is reached. The sliding seal exposes its sealing surface to the corrosive effects of the ambient so that its reliability may be questionable under certain circumstances. The release appears to be depth limited insofar as high pressures of greater than 10,000 psi apparently cannot be withstood. The actuation of the pressure release could be influenced by load accelerations that may prematurely actuate the device, decelerations could retard its timely operation or other hydrodynamic influences on the load may influence the release. Since the parts separate upon actuation, reuse may be difficult.

Thus a continuing need exists in the state of the art for a mechanical release that is set at one pressure and actuated at another and which is reusable and not overly affected by environmental and dynamic influences associated with the load.

SUMMARY OF THE INVENTION

The present invention is directed to providing an apparatus for releasing a member connected to a float after a predetermined pressure cycle. A housing receives the member in a slidable relationship and a latch holds it in a releasable engagement in a first position, a second position and a third position attainable only after the second position has been effected. A biasing spring moves the latch to the second position when the apparatus encounters a first ambient pressure. The first ambient pressure deflects a flexible diaphragm with a diaphragm spring that is sealed in the housing in a non-slidable manner so that it abuts the latch when it is in the second position. An appropriately shaped solid stop receives the flexible diaphragm at the first ambient pressure level and those pressures greatly in excess of the first ambient pressure to prevent damage of the flexible diaphragm. The diaphragm spring displaces the diaphragm to move the latch to the third position to assure the release of the member and its interconnected float when the apparatus encounters the second ambient pressure which is at a lesser predetermined magnitude than the first ambient pressure.

An object of the invention is to provide for a reliable mechanical release actuated at a pressure which is lesser than a maximum encounterable pressure.

Another object is to provide a mechanical release that is self resetting and requires no refurbishment before being reused.

Another object of the invention is to provide a mechanical release that is set by a first pressure to effect a release at a second ambient pressure which is less than the first pressure.

Another object of the invention is to provide a release mechanism that has no moving seals such as found in piston actuated devices to provide a greatly improved reliability at high pressures.

Another object of the invention is to provide a release mechanism having a solid stop configured to receive a nonsliding flexible diaphragm so that extreme pressures can be encountered without affecting the mechanism's capability for reliable release at a lower ambient pressure.

Still another object of the invention is to provide a mechanical release device having reproducible actuation pressures due to selectable springs to avoid the inconsistency associated which shear pin pressure-release-devices.

These and other objects of the invention will become more readily apparent from the ensuing specification when taken in conjunction with the appended claims and associated drawings.

DESCRIPTION OF THE PREFERRED EMBODIMENT

Figure 1:
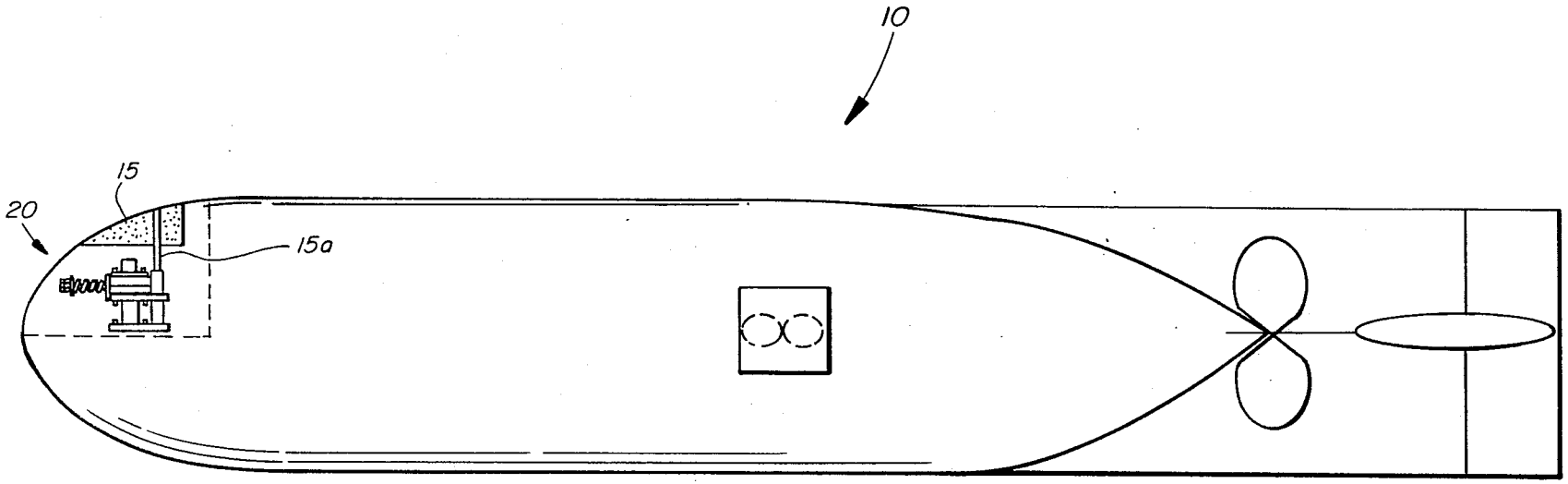
FIG. 1 shows the invention in an exaggerated scale operationally disposed to release a float from a submersible.

Referring now to FIG. 1 of the drawings, a submersible 10 has an appropriate propulsion and guidance system for traveling to great ocean depths for data gathering and other tasks. A flotation package 15 has a member 15' joined to the submersible by a mechanical release device 20 fabricated in accordance with the teachings of this inventive concept. The release device is shown in a greatly exaggerated scale with respect to the size of the submersible to provide a reader with a continuity in the description of this concept. It is understood that this release device is capable of being fabricated in a compact design to enable its application in a wide variety of uses without compromising the effectiveness of its host vehicle.

Although a ballast or buoyancy package 15 has been referred to, optionally, the device could also be appropriately arranged to release a ballast if needed or the package may contain appropriate instrumentation for deployment as the submersible continues its mission. For the purposes of this description, however, the package will be considered as being ballast which is released prior to coming to the surface so that the submersible can be more easily recovered by a surface support vessel.

Irrespective what the purpose of releasably affixed package 15 may be, a distinguishing feature of the mechanical pressure release is that it is armed or set when it is subjected to a first ambient pressure so that subsequently it can effect the release of package 15 when it is subjected to a lesser predetermined ambient pressure.

Figure 2:
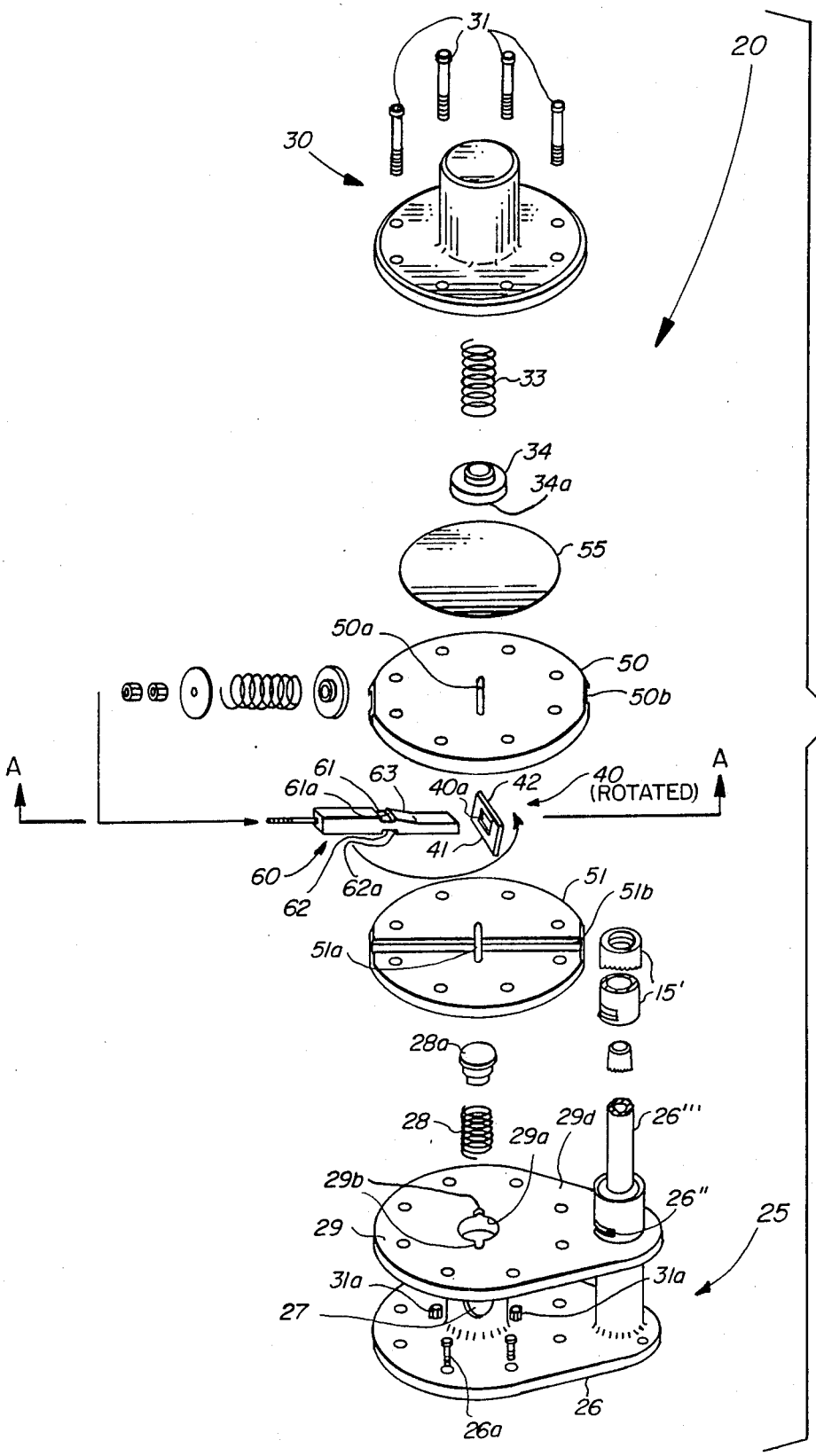
FIG. 2 is an exploded view of the invention.

Referring now to FIG. 2 the exploded view of release device 20 provides insight into the uncomplicated and, hence, reliable operational capabilities of this device.

A housing 25 includes a bracket member 26 that secures the release device to the submersible by a number of threaded bolts 26*a* extending through appropriately disposed holes. The bracket member has a guide shaft 26' with an opening 26'' and an axial pin 26''' extending from it to support a larger hollow shaft 15' extending from float 15. Bracket member 26 is configured to define a vented, essentially cylindrically shaped volume 27 to retain a helical spring 28. The bracket member also has a bracket member portion 29 provided with an axial bore 29*a* sized to slidably receive helical spring 28 and a piston 28*a*. A pair of diametrically opposed, radially extending lateral slots 29*b* are machined in portion face 29*d* of bracket member portion 29. The spring is retained in a normally compressed condition between bracket member 26 and spring piston 28*a* to exert a biasing force via the spring piston bearing against a flat bearing surface 41 provided on a latch member 40. The latch member is sized to be guided and retained in lateral slots 29*b* to permit reciprocable motion into and out of the slots when predetermined ambient pressures are encountered.

An essentially hat-shaped member 30 is secured to bracket member portion 29 by a plurality of elongate threaded bolts 31 fitted through aligned holes provided in the hat-shaped member and the bracket member portion. A bore 32 is drilled in hat shaped member 30 and is sized to slidably contain a lower pressure spring 33 that is maintained in a compressed relationship between a closed end of the bore and a cap member 34 having an appropriately contoured surface 34*a*. It is to be noted that spring 33 in bore 32 and spring 28 in cylindrically shaped volume 27 are coaxially disposed to exert opposing forces. The magnitudes of the forces exerted determine what the ambient pressures are to provide a desired actuation sequence. The forces exerted by the springs can be changed readily to provide considerable latitude in the application of this concept.

A pair of essentially disk-shaped guide members 50 and 51 are sandwiched between hat-shaped member 30 and bracket portion 29 when nuts 31*a* are tightened on the number of bolts 31 which extend through appropriately disposed aligned holes in the guide members, the hat-shaped member and the bracket portion. A pair of aligned guide slots 50*a* and 51*a* and a lateral guide cuts 50*b* and 51*b* are machined in guide members 50 and 51, respectively. The guide slots are sized to allow reciprocal axial travel of latch member 40 as ambient pressure fluctuations are encountered by the apparatus of this inventive concept. The guide cuts diametrically extend across the guide members and define an essentially square cross-sectional lateral channel 52 in guide members 50 and 51 to receive a notched bar 60 and allow passage of the notched bar when predetermined ambient pressures are encountered, see FIGS. 3, 4 and 5.

Latch member 40 is a flat plate configured with flat bearing surface 41 at one end and rounded contoured bearing surface 42 at its opposite end. The center of latch member is machined-away to define an essentially square opening 40*a* having a tapered side 40*b* with a tapered edge 40*b'* and a square shoulder 40*c* on its opposite side. The appropriately rounded configuration of contour 42 accommodates one side of a flexible diaphragm member 55 that is abutted on its opposite side by cap member 34.

Diaphragm member 55 is a an appropriate flexible material, such as a titanium diaphragm about ten thousandths of an inch thick that has a sufficient elasticity to deflect approximately 1/16 of an inch. It functions in much the same manner as a rubber diaphragm but is more rugged to withstand the abuses likely in an ocean application. The diaphragm member is seated on an O-ring 56 fitted into a groove 57 in the face of hat-shaped member 30. An appropriately contoured, essentially conically-shaped portion of the hat-shaped member is machined away to define a cone-shaped solid stop surface 57 disposed radially inwardly of O-ring 55 and which is roughly 1/16 of an inch deep. The interior of bore 32 containing spring 33 is sealed from the ambient by reason of O-ring 56. Because of the flexibility of diaphragm 55 no sliding of the O-ring is called for, however.

An elongate notch bar 60 is sized to fit within guide channel 52 in a slidable relationship and to extend through the square opening 40*a* of latch member 40, see again FIG. 2. A notch 61 with an edge 61*a*, a notch 62 with a shoulder 62*a* and an inclined surface 63 are machined in bar 60 so that after a preset sequence when the notches are disengaged from latch member 40, a bar biasing spring 64 pulls notch bar 60 from guide channel 52. When this occurs an end portion 65 of the notch bar is withdrawn from an appropriately shaped slot 15*a* in tube 15' connected to float 15.

Figure 3:
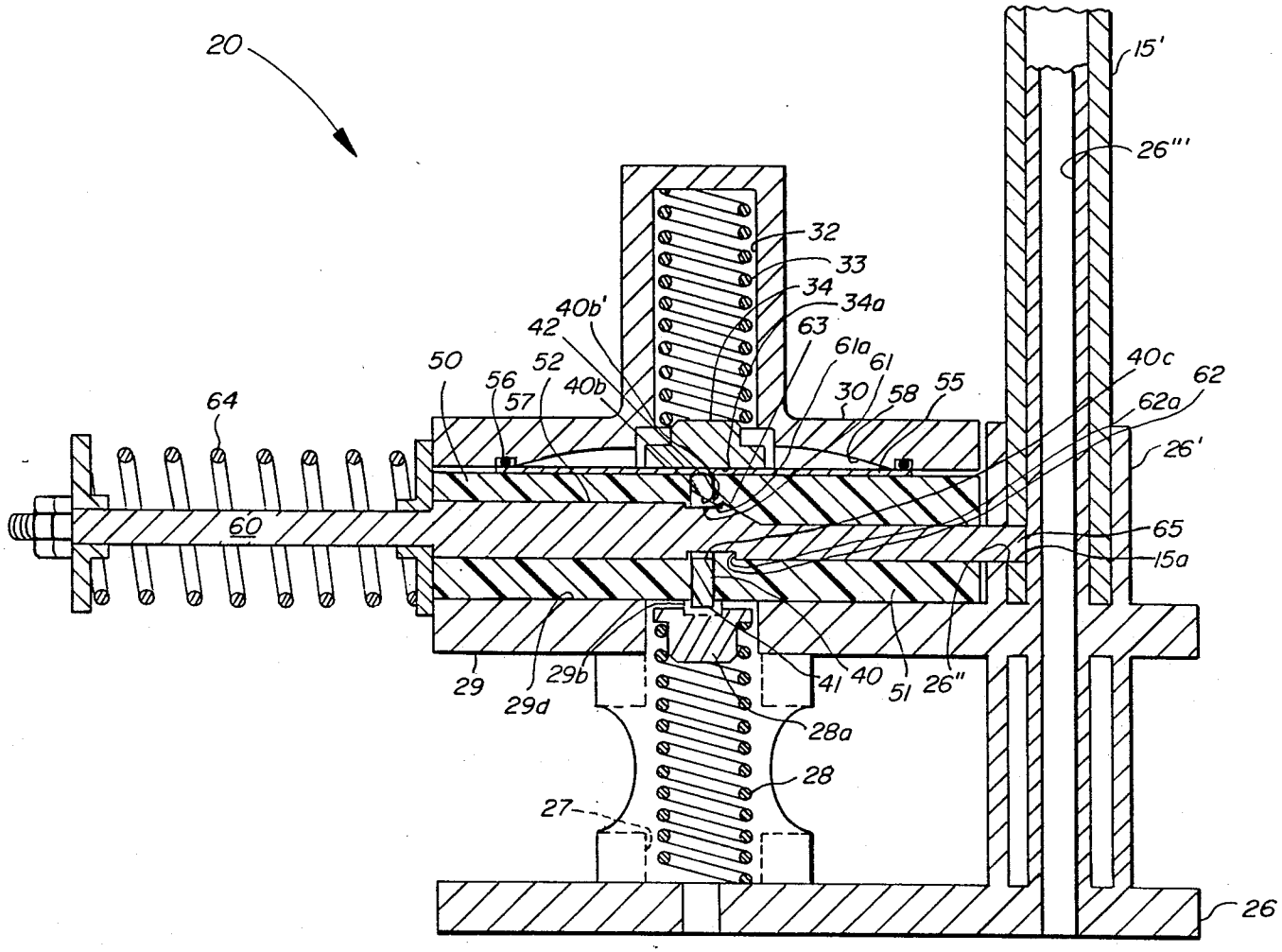
FIG. 3 is a cross-sectional view taken generally along line A—A in FIG. 2 after the release device is assembled and a notched bar is in an initial position or ready state prior to launch.

Referring now to FIG. 3 the mechanical pressure release is shown in its assembled configuration prior to launch. Part of latch 40 occupies the volume defined in lateral slots 29*a* in bracket member portion 29. Edge 40*b'* of tapered side 40*b* engages edge surface 61*a* of notch 61. The biasing force exerted by compressed biasing spring 28 is predetermined to be relative to the force exerted by spring 33 so that latch member 40 is maintained in an upwardly displaced position in lateral slots 29*a* so that edge 40*b'* of tapredr side 40*b* engages edge surface 61*a* of notch 61. End portion 65 is engaged in slot 15*a* to secure float 15 to submersible 10.

Figure 4:
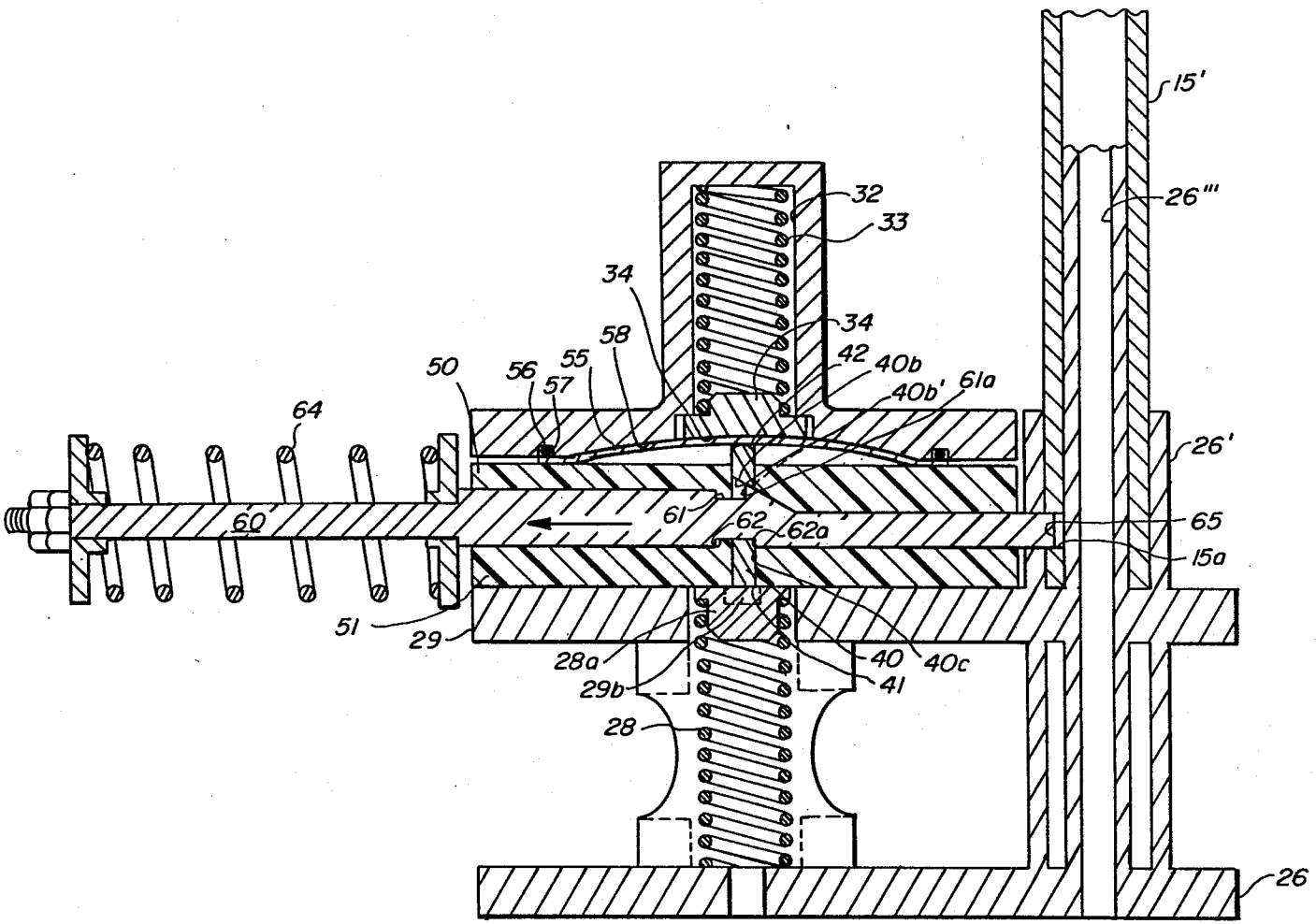
FIG. 4 is a cross-sectional view taken generally along line A—A in FIG. 2 after the release device is assembled and subjected to a sufficient pressure (depth) to displace the diaphragm and the notched bar to actuate the device to a set or an armed state.

Looking to FIG. 4, the release mechanism 20 on submersible 10 is taken to a depth greater than, say fifty feet. The ambient water pressure acting on diaphragm member 55 pushes it upward so that the ambient pressure force plus the force exerted by spring 28 overcomes the force exerted by diaphragm spring 33. Since contoured bearing surface 42 abuts diaphragm member 55 and biasing spring 28 pushes piston 28*a* against latch member 40 via bearing surface 41, latch member 40 is moved upward out of lateral slots 29*a* to disengage edge 40*b'* of tapered side 40*b* from edge surface 61*a* of notch 61. The force exerted by bar biasing spring 64 moves notched bar 60 to the left in the arrow direction shown on the notched bar and places shoulder 62*a* of notch 62 against shoulder 40*c* of latch member 40 and further motion is arrested. Diaphragm member 55 rests against the cone shaped solid stop surface 58 and deformation or damage of the diaphragm is prevented irrespective that extreme pressures far beyond those at fifty feet may be encountered. There is no sliding of any sealed surfaces and the interior of hat shaped member 30 remains sealed because diaphragm 55 is seated on O-ring 56.

Figure 5:
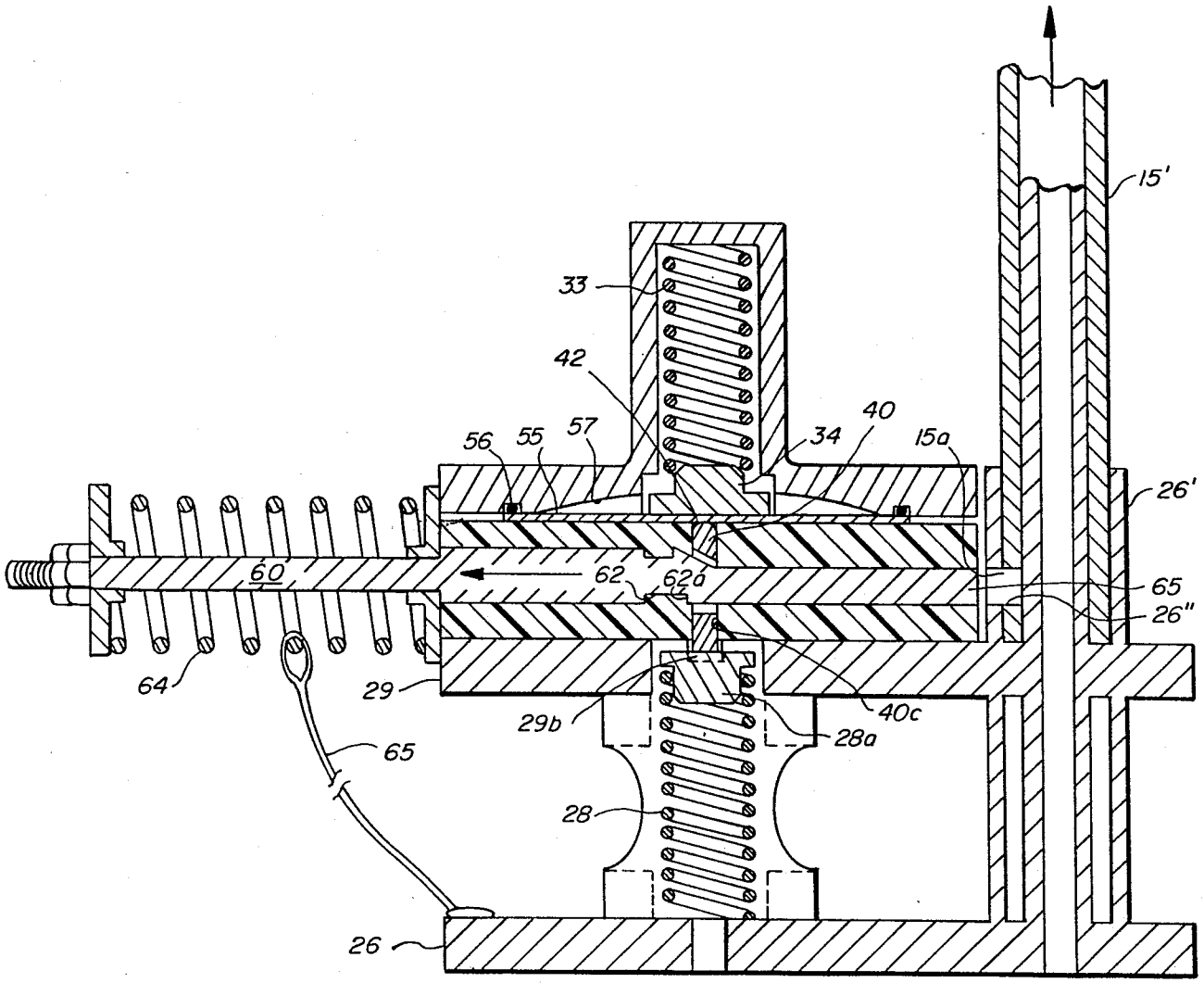
FIG. 5 is a cross-sectional view taken generally along line A—A in FIG. 2 after the release device is assembled and is at a lesser pressure (shallower depth) as the notched bar is being released.

Looking now to FIG. 5 as submersible 10 approaches the surface at a depth of, say less than fifty feet, the lessening ambient pressure on diaphragm member 55 is overcome by the force exerted by spring 33 such that diaphragm 55 is displaced downward. Since contoured bearing surface 42 of latch member 40 abuts diaphragm member 55, the downward travel by the diaphragm displaces latch member 40 downward and into lateral slots 29*a*. This downward displacement of the latch member effects a disengagement of shoulder 40*c* from shoulder 62*a* of notch 62 and biasing spring 64 extracts end portion 65 in the arrow direction shown from slot 15*a* in shaft 15' of float 15. A line, not shown, connects the released float to the submersible so that a surface support vessel can recover the craft. A lanyard 65 is attached to biasing spring 64 and prevents loss of notch bar 60 for subsequent reuse.

The deflection of thin metal diaphragm 55 causes the release of ballast 15 at a relatively lower hydrostatic pressure. The diaphragm member is titanium and so chosen for its properties of high strength and relative flexibility. Its corrosion resistance is highly desirable and all of the constituents of the mechanical release mechanism are fabricated from corrosion resistant materials. Stainless steel and some space age plastics might find suitable application without departing from the intent of the inventive concept. There are no moving seals in the disclosed design and, hence, the reliability is greatly enhanced. Once the springs have been selected, the actuation pressures are reproducible and, thus, have a greater reliability as compared to shear-pin models that have variations among the batch materials used. The self-resetting feature of the invention enables its reuse once notched bar 60 is reinserted in guide channel 52 and is appropriately engaged with latch member 40. Further refurbishing is not necessary.

This concept which is being discussed with respect to an ocean application may be deployed in other than an aqueous medium where pressure variations will occur. Although the above description concerned itself with reference to upward and downward relative motions and displacements, it is to be understood that this inventive concept lends itself to a wide variety of orientations. The relative orientations have been relied upon in this description only to avoid unnecessary verbiage.

Although a specific embodiment to the invention has been described in considerable detail for illustrative purposes many modifications will occur to those skilled in the art. It is therefore to be understood that within the scope of the appended claims the invention can be practiced otherwise than as specifically described.

We claim:

1. An apparatus for releasing a member after a predetermined pressure cycle comprising:

means for housing the member in a slidable relationship;

means mounted in the housing means for latching the member in a releasable engagement thereof in a first position and a second position and release thereof at a third position attainable only after said second position has been effected;

means mounted in said housing and abutting the latching means for biasing it to said second position when said apparatus encounters a first ambient pressure; and means disposed in said housing and abutting said latching means when said latching means is in said second position for displacing it to said third position to assure said release of said member when a said apparatus is subjected to a second ambient pressure which is at a predetermined magnitude that is less than said first ambient pressure, the displacing means includes a flexible diaphragm seared on an O-ring in a nonslidable relationship and an appropriately shaped solid stop to prevent damage of said flexible diaphragm at said first ambient pressure and at pressures greatly in excess of said first ambient pressure.

2. An apparatus according to claim 1 in which said flexible diaphragm is deflected toward said solid stop by said first ambient pressure to allow the biasing means to move said latching means to said second position.

3. An apparatus according to claim 2 in which said biasing means has a spring to assure the moving of said latching means toward said second position and said displacing means has a preset spring abutting said flexible diaphragm to help assure said release of said member when said second ambient pressure is encountered.

4. An apparatus according to claim 3 in which said member is connected to a mass having a buoyancy different from the ambient and has a member spring to extract said member from said housing when said latching means is at said third position.

5. An apparatus according to claim 4 in which said member spring is interconnected to said member to displace said member to appropriately allow the biasing means to move said latching means to said second position.

6. An apparatus according to claim 5 in which said member is an elongate bar having a notch on either side and said latching means is a plate shaped element having an essentially rectangularly shaped opening with a tapered side and a shoulder which selectably engage either of the notches at said first position and at said second position.

7. An apparatus according to claim 6 in which said plate shaped element has a contoured surface for engaging said flexible diaphragm.

8. An apparatus according to claim 7 in which said flexible diaphragm is a thin titanium disk, said solid stop is essentially cone-shaped and said O-ring is included adjacent said disk to seal said preset spring in said housing means.

9. An apparatus according to claim 8 in which said biasing means, said displacing means and said latching means are coaxially aligned with respect to each other.

10. An apparatus according to claim 9 in which said member is orthogonally disposed with respect to the coaxially aligned said biasing means, said displacing means and said latching means.

11. An apparatus according to claim 10 in which said housing means, said latching means, said biasing means and said displacing means are fabricated from corrosion resistant materials.

* * * * *